United States Patent [19]

Nithart et al.

[11] Patent Number: 4,707,214

[45] Date of Patent: Nov. 17, 1987

[54] TAPING MACHINE FOR HOT TAPING AN ELECTRICAL CONDUCTOR

[75] Inventors: Henri Nithart, Belfort; Robert Graftiaux, 8 rue de l'Eglantine, 69500 Bron, both of France

[73] Assignees: Alsthom; R. Graftaiux, both of France

[21] Appl. No.: 929,704

[22] Filed: Nov. 13, 1986

[30] Foreign Application Priority Data

Nov. 14, 1985 [FR] France ..... 85 16844

[51] Int. Cl.[4] ..... B65H 81/00

[52] U.S. Cl. ..... 156/392; 156/185; 156/195; 156/428; 156/430; 156/497; 156/499

[58] Field of Search ..... 156/184, 195, 425, 428–432, 156/443, 475, 468, 391–392, 499, 497, 185

[56] References Cited

U.S. PATENT DOCUMENTS

| | | | |
|---|---|---|---|
| 2,027,704 | 1/1936 | Rosener | 156/392 |
| 3,470,057 | 9/1969 | Stuart et al. | 156/392 X |
| 3,636,691 | 1/1972 | Bonvallet | 156/392 X |
| 3,837,970 | 9/1974 | Medrano | 156/195 X |
| 4,322,262 | 3/1982 | Cottam | 156/497 X |
| 4,338,153 | 7/1982 | Zimmerman | 156/391 |

FOREIGN PATENT DOCUMENTS

| | | | |
|---|---|---|---|
| 962716 | 4/1957 | Fed. Rep. of Germany . | |
| 2722011 | 12/1978 | Fed. Rep. of Germany | 156/429 |
| 2025820 | 9/1970 | France . | |

*Primary Examiner*—David Simmons

*Attorney, Agent, or Firm*—Sughrue, Mion, Zinn, Macpeak and Seas

[57] ABSTRACT

A taping machine (10) for hot taping an electrical conductor (1), the machine comprising an outer ring (20) which is fixed so as not to rotate relative to the conductor and which receives the conductor to be insulated passing through the center thereof, and a rotating ring (30) rotating inside said fixed ring and carrying at least one reel (53) having pre-impregnated insulating tape (2) wound thereon, the taping machine and the conductor being caused to move relative to each other in translation while said rotating ring is simultaneously caused to rotate relative to the conductor to cause the, or each, tape to be helically wound around the conductor, said fixed ring including a peripheral channel (21) which is fed with hot air, and said rotating ring being provided with a rotating assembly (50) including a plate (51) for closing said peripheral channel, at least one spout rotating around said peripheral channel, and at least one associated heating nozzle (55) which is fed with hot air via said spout, with each tape running along a transfer passage of a corresponding heating nozzle. The invention is applicable to insulating and calibrating the dimensions of conductors for large electrical machines.

5 Claims, 3 Drawing Figures

TAPING MACHINE FOR HOT TAPING AN ELECTRICAL CONDUCTOR

The present invention relates to a taping machine for hot taping an electrical conductor.

BACKGROUND OF THE INVENTION

In large electric machines, the technique for insulating conductors consists in helically winding one or more layers of insulating tape onto the conductor, and in calibrating the dimensions of the conductor by means of pressure rolls after each layer has been laid. The insulating tapes currently used are pre-impregnating tapes which must be heated to several tens of degrees centigrade so as to give them the viscosity during laying suitable for them to slide naturally over the conductor or over the spiral of previously laid tape, using the film of resin as a lubricant. This natural tape sliding then avoids problems of the tape expanding or swelling which would hinder subsequent calibration of the conductor.

In prior taping machines, the tape is heated by directly heating the tape-carrying reel installed on a paying-out device, and/or heating the conductor upstream from the taping machine.

When the tape is heated at the reel, i.e. at a distance from the conductor, a problem of tackiness rises since the film of resin tends to run before the tape has actually been put into place.

The heating provided for the tape solely by preheating the conductor upstream from the taping machine is inadequate.

Combining these two modes of heating the tape does not avoid the major drawback of the first known means of heating, namely the considerable expansion which occurs leading to poor calibration.

The aim of the present invention is to provide good calibration of conductor dimensions by greatly reducing the extent to which tapes may expand, with said considerable reduction in expansion being obtained by heating the tape as close as possible to the conductor, i.e. immediately before putting the tape into place on the conductor.

SUMMARY OF THE INVENTION

The present invention provides a taping machine for hot taping an electrical conductor, the machine comprising an outer ring which is fixed so as not to rotate relative to the conductor and which receives the conductor to be insulated passing through the center thereof, and a rotating ring rotating inside said fixed ring and carrying at least one reel having preimpregnated insulating tape wound thereon, the taping machine and the conductor being caused to move relative to each other in translation while said rotating ring is simultaneously caused to rotate relative to the conductor to cause the, or each, tape to be helically wound around the conductor, said fixed ring including a peripheral channel which is fed with hot air, and said rotating ring being provided with a rotating assembly including a plate for closing said peripheral channel, at least one spout rotating around said peripheral channel, and at least one associated heating nozzle which is fed with hot air via said spout, with each tape running along a transfer passage of a corresponding heating nozzle.

Generally speaking, either the taping machine is fixed and the conductor runs through the taping machine while being guided and driven by two automatic carriages, or else the taping machine is movable in translation while the conductor remains fixed, with the taping machine being guided and driven by two automated carriages or being driven by wheels running over two faces of the conductor.

In either configuration, the taping machine includes a calibrating device disposed downstream from the tape-laying position and constituted by pairs of horizontal and vertical rolls.

BRIEF DESCRIPTION OF THE DRAWINGS

A taping machine in accordance with the invention and driven in translation along a fixed conductor by two vertical wheels is described below by way of example with reference to the accompanying drawings, in which.

MORE DETAILED DESCRIPTION

Figure 1:
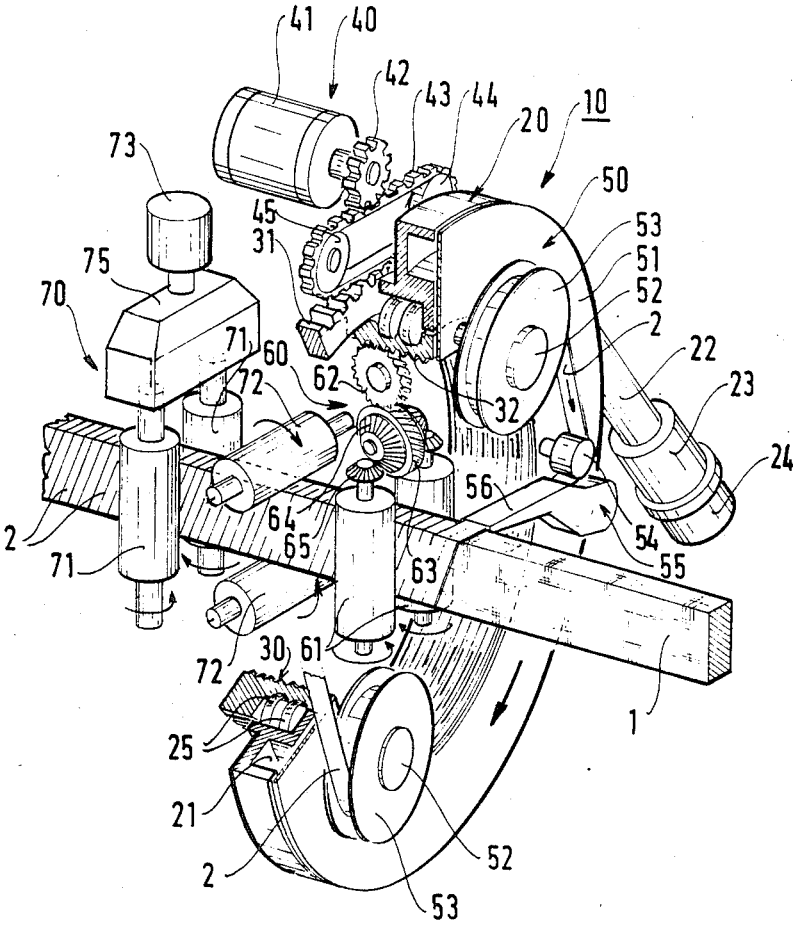
FIG. 1 is a fragmentary perspective view of a taping machine in accordance with the invention.

FIG. 1 shows a fixed conductor 1 on which a first layer of tape 2 is being wound. This figure also shows a machine 10 comprising a fixed ring 20, a rotating ring 30, a drive mechanism 40 for said rotating ring 30, a rotary assembly 50 fixed to the rotating ring 30, a drive mechanism 60 for driving the machine along the conductor 1, and a device 70 for calibrating the tape after it has been put into place.

The fixed ring 20 is suspended from an overhead crane (not shown) capable of running freely along a rail. The fixed ring comprises a U-shaped portions defining peripheral rectangular U-shaped channel 21 which is open on a side closed by a closure plate 51. Four hot air supply tubes 22 (all four of which are visible in FIG. 3) are provided thereon, with each tube 22 comprising a blower 24 and a heater 23. Each tube 22 thus serves to feed the peripheral channel 21 with hot air.

The rotating ring 30 runs over wheels 25 and includes teeth 31 by which the rotating ring is driven and an internal screw thread 32 by which the rotating ring drives a wheel 62.

The drive mechanism 40 through the ring 30 is constituted by a motor 41 having a gear wheel 42 mounted on its shaft. Two pulleys 44 and 45 bear an outwardly toothed belt 43 which is driven by the gear wheel 42 and which in turn drives the teeth 31 of the ring 30.

The rotating assembly 50 is fixed on the rotating ring 30 and includes the plate 51 closing the channel 21.

Figure 3:
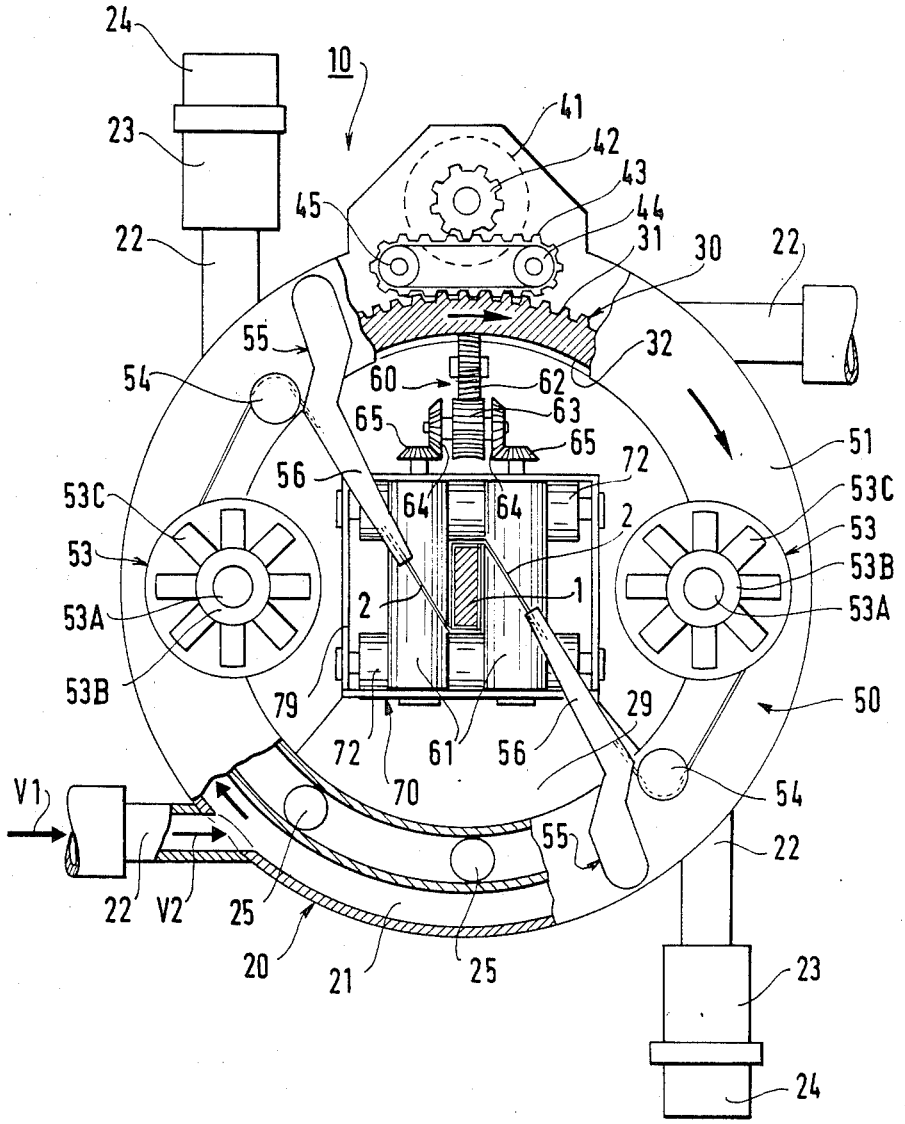
FIG. 3 is a front view of the taping machine showing the rotary assembly advanced by a quarter turn relative to the position shown in FIG. 1.

The plate 51 receives two shafts 52 each having a tapecarrying reel 53 mounted thereon. FIG. 3 shows that the reel 53 is held on the shaft 52 by means of a "quarter-turn" knurled knob 53A and is braked to a greater or lesser extent on the shaft 52 by a knurled bolt 53B which adjusts the tension of a spring 53C.

The plate 51 has two guide wheels 54 and two heating nozzles 55, with only one guide wheel and one heating nozzle being shown in FIG. 1. Each guide wheel 54 serves to direct the corresponding tape along a transfer passage 56 of the corresponding nozzle 55, so that each tape is held taut between the conductor 1 and the corresponding guide wheel 54, and so that each transfer passage 56 extends from the corresponding guide wheel 54 mounted on the plate 51 up to the vicinity of the conductor 1.

Each nozzle 55 receives its hot air from a spout 57 (see FIG. 2) which is fixed to the plate 51 and which therefore rotates along the channel 21.

The drive mechanism 60 for driving the taping machine 10 along the conductor is constituted by two wheels 61 and the wheel 62 which is driven by the thread 32 on the inside of the rotating ring 30, via a further wheel 63 which is driven by the wheel 62, said further wheel 63 including a set of bevel teeth 64 on each side thereof for meshing with mating bevel teeth 65 on respective gear wheels for driving said wheels 61 which run along parallel faces of the conductor 1.

Naturally, if the taping machine is driven by two automated carriages, the drive mechanism 60 may be omitted.

Downstream from the position at which the tapes are laid, there is a calibrating device 70 constituted by four rolls, i.e. two vertical rolls 71 and two horizontal rolls 72. Naturally, means may be provided just upstream from the calibrating device for heating the conductor in order to obtain even better calibration.

The four rolls are driven by a motor 73 driving a differential 75 for the two vertical rolls 71 and a sutiable mechanism (not shown) for driving the two horizontal rolls 72.

The distance between the axes of the vertical rolls and of the horizontal rolls are respectively adjustable in order to calibrate the outside dimensions of the tape conductor, and this can be done for each layer.

Figure 2:
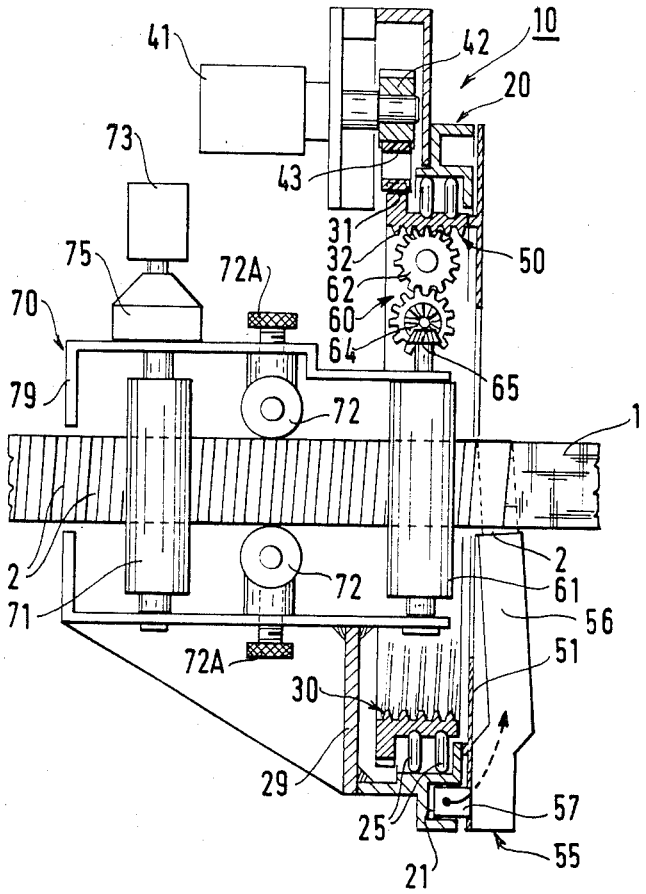
FIG. 2 is a section through a portion of the taping machine on a main vertical plane, with a nozzle being situated in said vertical plane and with the reels being omitted.

FIG. 2 shows a spout 57 which collects hot air from the channel 21 for injection into the transfer passage 56 of a nozzle 55.

FIG. 2 also shows a rear frame 29 fixed to a fixed ring 20, and a frame 79 fixed to the frame 29 and supporting the calibrating device 70. The frame 29 thus serves to guide the rolls 71 and 72 and also to guide the wheels 61. Naturally guide means for the wheels 62 and 63 (not shown) are also fixed to the frame 79. Two knurled wheels 72A are used for adjusting the distance between the axes of the rolls 72, and two other knurled wheels (not shown) serve to adjust the distance between the axes of the rolls 71.

FIG. 3 shows clearly that hot air coming from the tubes 22 is projected into the channel 21 and against the spouts 57 since these spouts rotate clockwise. This increases the hot air flowrate, and the speed of flow V4 along a passage 56 is constituted by the sum of the speeds V1, V2, and V3 where V1 is the speed at which ambient air enters a blower 24, V2 is the speed at which hot air is ejected into the channel 21, and V3 is the circumferential speed of a spout around the channel.

Any increase in taping machine displacement speed causes an increase in the speed at which the tape runs along a transfer passage, however it also increases the speed as which gas flows along the transfer passage, so that the temperature of the tape is thus properly regulated regardless of the speed at which the taping machine is displaced.

A taping operation takes place as follows:

the taping machine is placed at one end of a conductor;

each tape is passed along the transfer passage of the corresponding nozzle;

the tapes are fixed to the conductor;

the blowers are switched on and then the heaters are switched on in order to heat the transfer passages, and a probe prevents the taping machine being rotated until the temperature rise in the passages is satisfactory; and once the proper passage temperature has been reached, the motors 41 and 73 are switched on.

The motor 41 rotates the ring 30 and thus the plate 51 which winds the tapes around the conductor, and also rotates the wheels 61 which in turn drive the taping machine 10 along the conductor. The tapes are thus wound helically around the conductor.

The motor 73 rotates the four calibrating rolls which may optionally add to the drive effects from the wheels 61, but which are intended above all for calibrating the outside dimensions of the conductor.

We claim:

1. A taping machine for hot taping an electrical conductor to be insulated, said machine comprising; a relatively fixed outer ring said conductor passing through the center of said fixed outer ring, a rotating ring mounted for rotation inside said fixed ring and carrying at least one reel having pre-impregnated insulating tape wound thereon, means for moving the taping machine and the conductor relative to each other in translation, means for rotating said rotating ring simultaneously relative to the conductor to cause the, or each, tape to be helically wound around the conductor, said fixed ring including a peripheral channel which is fed with hot air, and said rotating ring being provided with a rotating assembly including a plate for closing said peripheral channel, at least one spout carried by said rotating ring and rotating around said peripheral channel, and at least one associated heating nozzle communicating with said channel and being fed with hot air via said spout, and each heating nozzle having a transfer passage with each tape running along a transfer passage of a corresponding heating nozzle.

2. A taping machine according to claim 1, wherein each transfer passage extends from a guide wheel mounted on said plate to a point close to said conductor.

3. A taping machine according to claim 1, wherein the fixed ring is provided with at least one hot air supply tube including a blower and a heater.

4. A taping machine according to claim 1, further including a taped conductor calibrating device disposed downstream on said conductor from the winding position of the tape(s) on the conductor.

5. A taping machine according to claim 4, wherein the calibrating device is constituted by two vertical rolls and two horizontal rolls.

* * * * *